US012116189B2

(12) United States Patent
Kim et al.

(10) Patent No.: US 12,116,189 B2
(45) Date of Patent: Oct. 15, 2024

(54) CONTAINER LID WITH INTEGRATED VENT BLOCKING MECHANISM

(71) Applicant: COMOTOMO 2022 INC., Sunnyvale, CA (US)

(72) Inventors: Sang Pyo Kim, Los Altos, CA (US); Yong Hyun Kyung, Incheon (KR)

(73) Assignee: Comotomo 2022 Inc., Sunnyvale, CA (US)

( * ) Notice: Subject to any disclaimer, the term of this patent is extended or adjusted under 35 U.S.C. 154(b) by 0 days.

(21) Appl. No.: 17/856,595

(22) Filed: Jul. 1, 2022

(65) Prior Publication Data

US 2024/0002114 A1 Jan. 4, 2024

(51) Int. Cl.
*B65D 51/16* (2006.01)
*B65D 43/02* (2006.01)

(52) U.S. Cl.
CPC ..... *B65D 51/1633* (2013.01); *B65D 43/0212* (2013.01); *B65D 2543/00092* (2013.01); *B65D 2543/00351* (2013.01); *B65D 2543/00527* (2013.01); *B65D 2543/00629* (2013.01); *B65D 2543/0074* (2013.01)

(58) Field of Classification Search
CPC ..... B65D 47/0809; B65D 47/0804; B65D 47/20; B65D 47/066; B65D 47/065; B65D 47/063; A47G 2019/2277; A47G 19/2272
See application file for complete search history.

(56) References Cited

U.S. PATENT DOCUMENTS 2,829,380 A * 4/1958 Wood ..... E03C 1/262 222/518
3,321,114 A * 5/1967 Croyle ..... B65D 47/2081 222/499
3,658,217 A * 4/1972 Collie ..... B65D 83/06 222/498
5,240,154 A * 8/1993 Van Den Berghe ... B65D 25/42 222/499

(Continued)

FOREIGN PATENT DOCUMENTS

JP S63188406 U 12/1988
JP 2014-534379 A 12/2014

(Continued)

OTHER PUBLICATIONS

Korean Intellectual Property Office, Office Action, Korean Patent Application No. 10-2022-0107286, Nov. 22, 2022, 14 pages.

(Continued)

*Primary Examiner* — Jeffrey R Allen
(74) *Attorney, Agent, or Firm* — WTA Patents

(57) ABSTRACT

Embodiments relate to a container lid with vent holes that are blocked for storage but automatically unblocked when a container attached to the container lid is heated. The heating of the container lid causes the pressure to build in the container, which pushes up an upper portion of the container lid. When the upper portion of the container lid is pushed up, the vent holes are unblocked and enable air or vapor to escape through the vent holes. In this way, the container lid may seal the container during storage but enables automatic (Continued)

venting during the heating of the container to prevent buildup of excessive pressure within the container.

19 Claims, 6 Drawing Sheets

(56) References Cited

U.S. PATENT DOCUMENTS

| | | | | |
|---|---|---|---|---|
| 5,597,096 | A * | 1/1997 | Jeppesen | B65D 47/0809 220/281 |
| 7,806,289 | B2 * | 10/2010 | McCandlish | A47G 19/2272 229/404 |
| 2008/0283485 | A1 | 11/2008 | Smith et al. | |
| 2014/0224370 | A1 | 8/2014 | Krauer et al. | |

FOREIGN PATENT DOCUMENTS

| | | | |
|---|---|---|---|
| KR | 101107377 | B1 | 3/2012 |
| WO | WO 94-14588 | A1 | 7/1994 |

OTHER PUBLICATIONS

International Search Report of PCT/US2023/025101 Mailed on Sep. 26, 2023.

* cited by examiner

CONTAINER LID WITH INTEGRATED VENT BLOCKING MECHANISM

BACKGROUND

1. Field of Art

The disclosure relates to a container lid, more specifically to a container lid that automatically opens its vent holes with the rise of pressure in a container.

2. Description of the Related Art

Containers for storing and cooking food have various shapes and sizes. Such containers usually accompany matching lids sized and structured to cover and seal the container. With the advent of microwave ovens, food may be placed in a microwavable container for cooking in the microwave oven, and left over food may be stored in the same container in a refrigerator. The food may be cooked in a microwave, placed in a refrigerator for storage, and subsequently removed from the refrigerator and placed in the microwave for reheating. The containers are generally closed by lids during storage to prevent spilling of its content or entering of contaminants into the containers. The lids are then removed from the containers before placing the containers in the microwave ovens to present buildup of excessive pressure within the containers.

SUMMARY

Embodiments relate to a container lid for sealing a container that automatically vents air or vapor when pressure within the container exceeds a threshold. The container lid includes a flange, a lower portion and an upper portion. The flange attaches onto a top end of the container. The lower portion extends inward and downward from the flange. The upper portion includes a top portion and a peripheral portion between the top portion and the flange. The peripheral portion is switchable between a first state where the peripheral portion is deformed upward to raise the top portion from the lower portion, and a second state where the peripheral portion is deformed downward to lower the top portion onto the lower portion. The peripheral portion is formed with one or more vent holes that are blocked by the lower portion in the second state but opened in the first state.

In one or more embodiments, the lower portion and the peripheral portion are separated in the first state and the lower portion contacts the peripheral portion in the second state.

In one or more embodiments, the peripheral portion switches from the second state to the first state when pressure within the container rises above a threshold.

In one or more embodiments, at least the peripheral portion is made of a flexible material.

In one or more embodiments, the flange, the lower portion and the upper portion are integrated as a single body.

In one or more embodiments, the upper portion is bistable at the first state and the second state.

In one or more embodiments, an inner end of the lower portion define a hole open towards the container.

In one or more embodiments, the peripheral portion is connected to the flange via a connection region having a thickness thinner than the peripheral portion and the flange.

In one or more embodiments, the thickness of the peripheral portion at a second part connected to the top portion is thicker than at the first part.

In one or more embodiments, the flange includes an annular body extending outwards and a hook. The hook has an inner rib and an inner groove that sealingly engage the container.

Embodiments also relate to a method of operating a container lid. One or more vent holes formed in a peripheral portion of an upper portion of a container lid are blocked by deforming the peripheral portion downward so that the peripheral portion is lowered onto a lower portion of the container lid that extends inward and download from a flange of the container lid that attached onto a top of the container. When pressure within a container attached with the container lid is increased above a threshold, the vent holes are unblocked by deforming the peripheral portion upward so that the peripheral portion is detached from the lower portion of the container lid. The pressure within the container is relieved by venting air or vapor through the unblocked one or more vent holes.

In one or more embodiments. the vent holes are blocked by having the lower portion contact the peripheral portion. The vent holes are unblocked by separating the lower portion and the peripheral portion.

In one or more embodiments, pressing force on a top portion of the upper portion is received to block the one or more vent holes by deforming the peripheral portion.

Embodiments also relate to a container assembly including the container and the container lid.

DETAILED DESCRIPTION OF EMBODIMENTS

Figure 1:
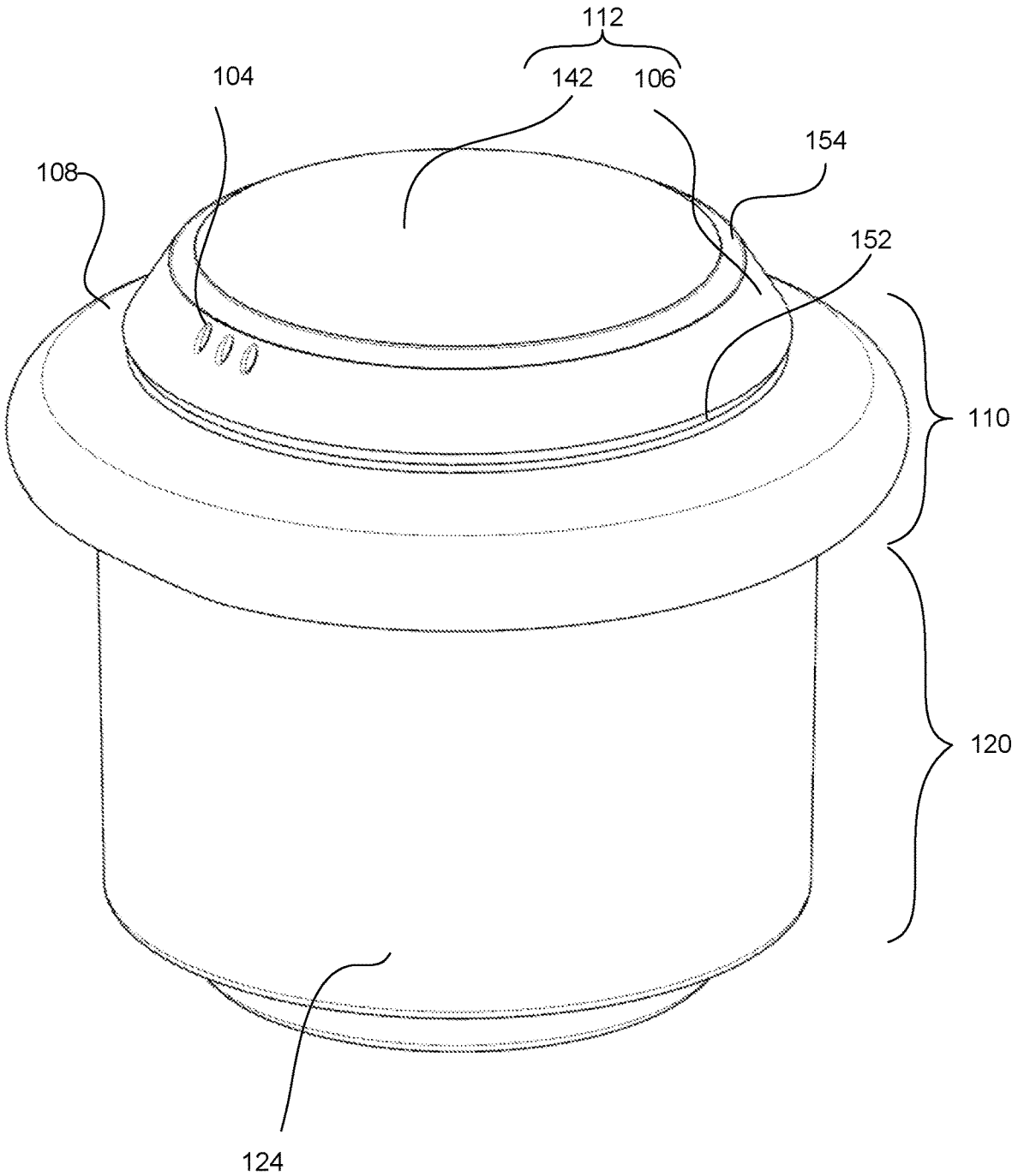
FIG. 1 is a perspective view of a container with a container lid popped up, according to one embodiment.

Embodiments are described herein with reference to the accompanying drawings. Principles disclosed herein may, however, be embodied in many different forms and should not be construed as being limited to the embodiments set forth herein. In the description, details of well-known features and techniques may be omitted to avoid unnecessarily obscuring the features of the embodiments. In the drawings, like reference numerals in the drawings denote like elements. The shape, size and regions, and the like, of the drawing may be exaggerated for clarity.

Embodiments relate to a container lid with vent holes that are blocked for storage but automatically unblocked when a container attached to the container lid is heated. The heating of the container lid causes the pressure to build in the container, which pushes up an upper portion of the container lid. When the upper portion of the container lid is pushed up, the vent holes are unblocked and enables air or vapor to escape through the vent holes. In this way, the container lid may seal the container during storage but enable automatic venting during the heating of the container to prevent buildup of excessive pressure within the container. The container lid is advantageous, among other reasons, because it is simple to use, has a unitary structure for easy manufacturing, and has a reliable and simple structure that is not susceptible to damage during everyday uses.

The container lid according to embodiments may be assembled onto the container for containing food items. After placing the food items in the container, the container lid may be sealed onto the container by fitting the container lid onto a top opening of the container, and then pushing down a top portion of the container lid. Such pushing action deforms a peripheral portion of the container lid, blocking vent holes in the peripheral portion, and thereby prevents contaminants from entering the container through the vent holes. The container sealed with the container lid may be stored (e.g., in a refrigerator). For consumption of the food item after storage, the container may be heated (e.g., using a microwave oven) with the container lid on. The heating of the food item increases the pressure within the container and pushes up the top portion of the container lid when the built-up pressure exceeds a threshold. In this way, the vent holes are automatically unblocked to release air and vapor from the container.

FIG. 1 is a perspective view of a container assembly including a container lid 110 and a container 120, according to one embodiment. The container lid 110 is attached onto a top opening of the container 120 after placing a food item into the container 120. Although the container lid 110 and the container 120 are shaped in circular or cylindrical columns in FIG. 1, in other embodiments, they may have angled or elliptic shapes (e.g., square or columnal shape).

The container lid 110 is dimensioned to fit onto the container 120 and seal the container 120. For this purpose, the container lid includes a flange 108, and an upper portion 112. The upper portion 112 includes a top portion 142 and a peripheral portion 106 between the flange 108 and the top portion 142. The peripheral portion 106 and the flange 108 are connected via a connection region 152 that is thinner to function as a scoring line relative to which the peripheral portion 106 is flexed. The flange 108 fits onto the container 120, as described below in detail with reference to FIGS. 4 and 5.

Figure 3:
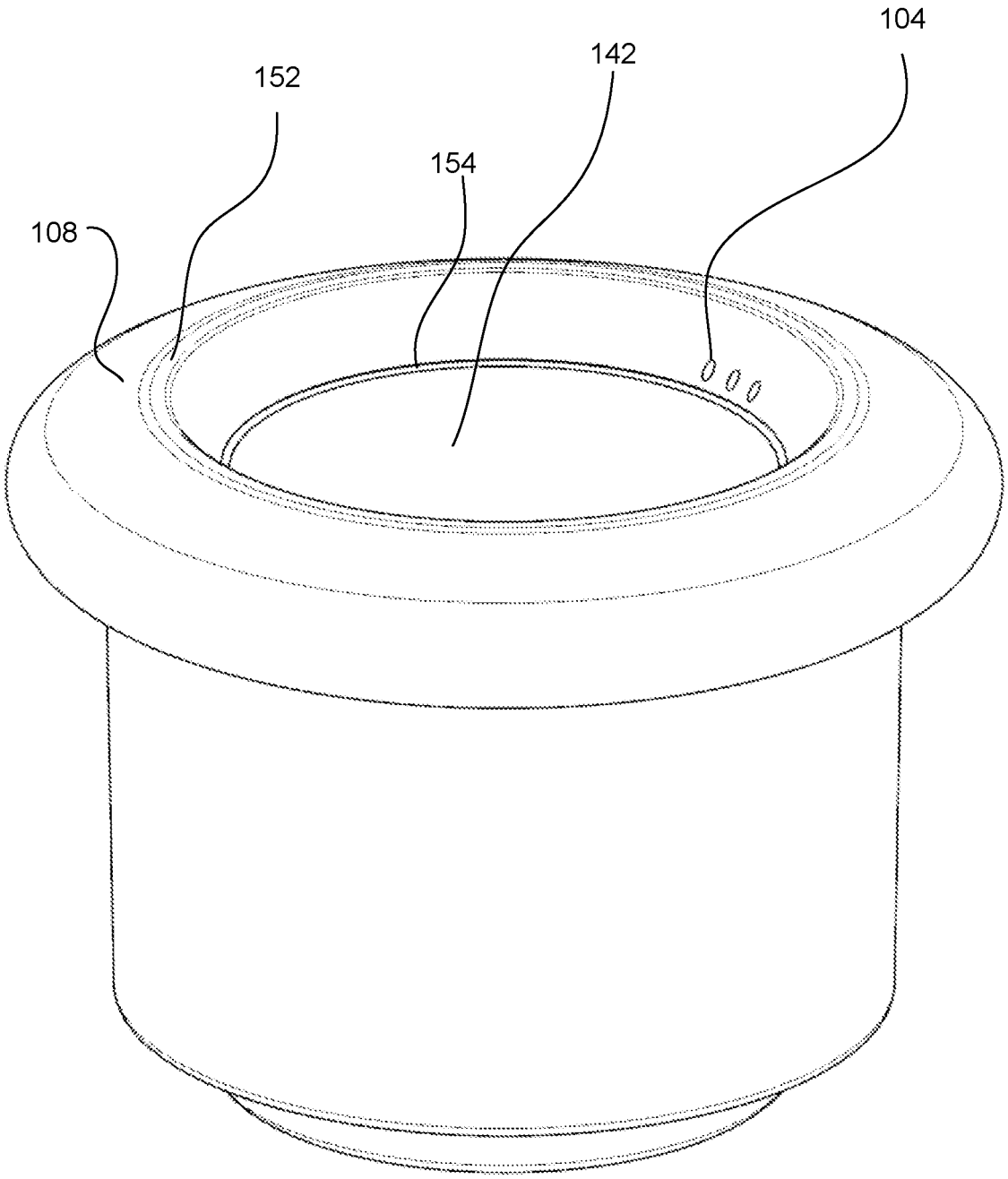
FIG. 3 is a perspective view of the container with the container lid pushed down, according to one embodiment.

The top portion 142 is at the highest location when the container lid 110 is in a popped up state (e.g., a first state), as shown in FIG. 1. When the container lid 110 is in a pushed down state (e.g., a second state), the top portion 142 is located lower than the flange 108, as shown in FIG. 3. The top portion is illustrated in FIG. 3 as being of a flat shape but the top portion may take various other shapes.

The peripheral portion 106 is flexible and has a bistable configuration where in one state (e.g., the first state), the top portion 142 is popped up, and in the other state (e.g., the second state), the top portion 142 is pushed down. The peripheral portion 106 may be made of a material and of a thickness profile that causes the peripheral portion 106 to deform between the two states when a certain amount of force or pressure is applied to the container lid 110. The peripheral portion 106 is formed with vent holes 104 that penetrate the peripheral portion 106. These vent holes 104 are blocked or unblocked depending on the state of the peripheral portion 106, as described below in detail with reference to FIGS. 4 and 5.

The container lid 110 may be of a unitary structure made of the same material. For example, the entire container lid 110 may be made of silicone with different thickness at different parts of the container lid. In this way, the entire container lid 110 may be fabricated using a single injection molding process without involving separate assembling of parts. Alternatively, the top portion 142 and the flange 108 may be made of a solid material (e.g., plastic) whereas the peripheral portion 106 is made of a flexible material (e.g., silicone).

Figure 2:
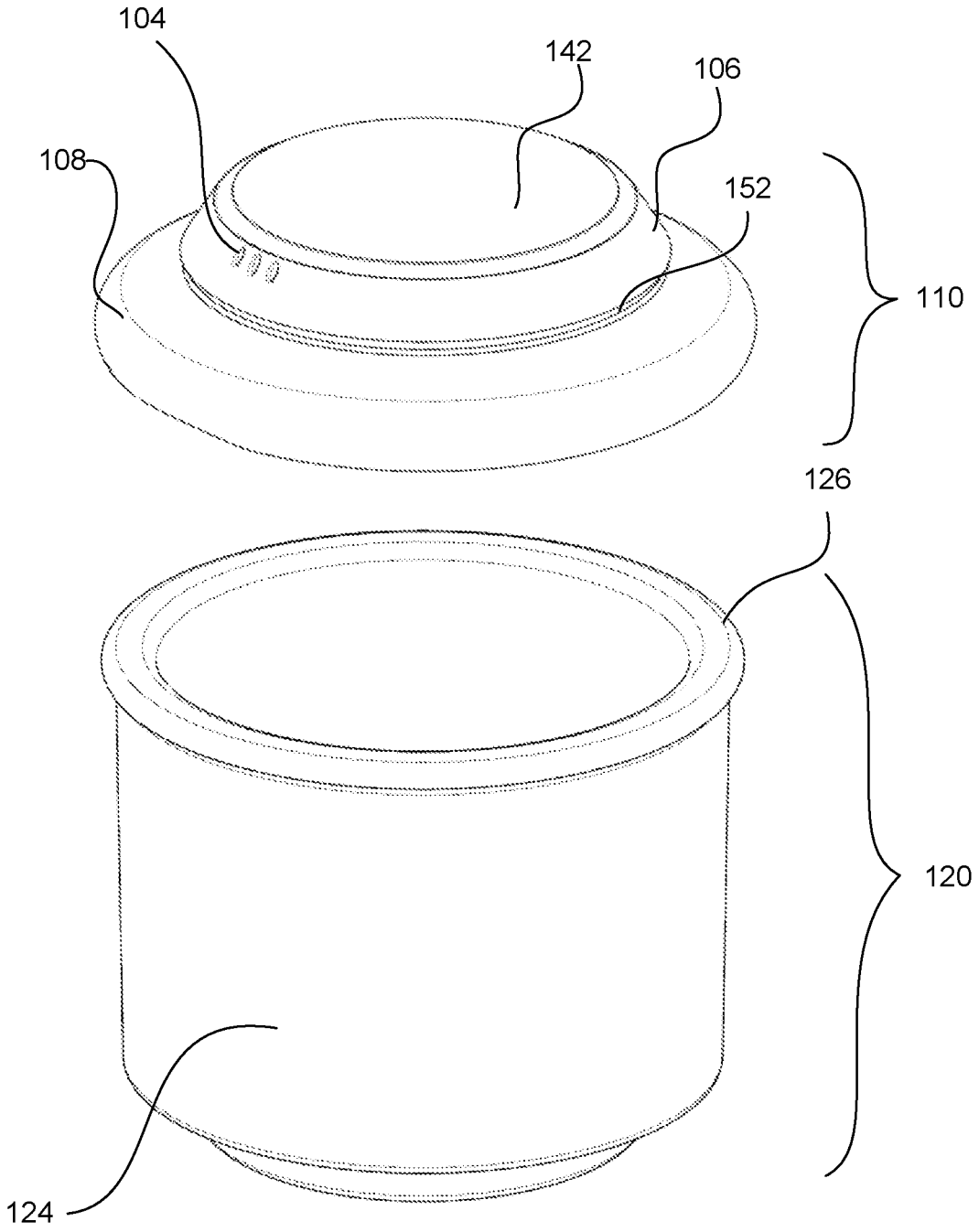
FIG. 2 is an exploded view of the container and the container lid, according to one embodiment.

FIG. 2 is an exploded view of the container 120 and the container lid 110, according to one embodiment. The container 120 may have a side wall 124 that has a rim 126 at the top. The rim 126 may have a structure that allows the flange 108 to lock onto the container 120, as described below in detail with reference to FIGS. 4 and 5. In one or more embodiments, the container 120 may be made of a solid material such as glass or plastic.

FIG. 3 is a perspective view of the container 120 with the container lid 110 pushed down, according to one embodiment. When the top portion 142 of the container lid 110 is pushed down (e.g., by a user's finger), the peripheral portion 106 deforms and lowers the top portion 142. By doing so, the vent holes 104 are blocked and prevents external contaminants from entering the container 120.

Figure 4:
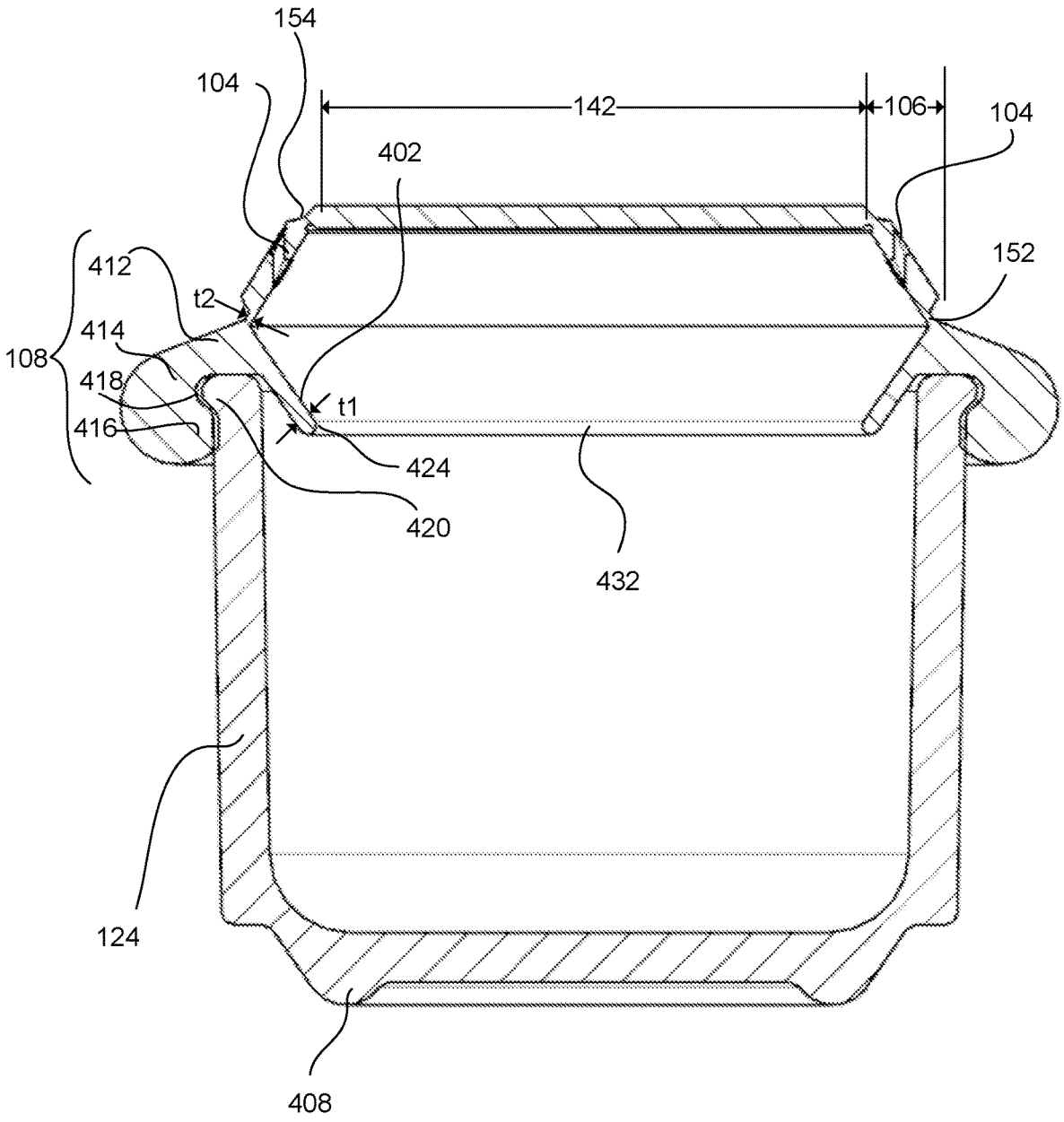
FIG. 4 is a cross-sectional view of the container with the container lid popped up, according to one embodiment.

FIG. 4 is a cross-sectional view of the container 120 with the container lid 110 popped up, according to one embodiment. The container lid 110 has a lower portion 402 that extends downward and inward from the flange 108. The lower portion 402 may be connected to the flange 108 and its lower inner edge defines a hole 432 that is open to the interior of the container 120. In one or more embodiment, the lower portion 402 is made of the same material and integrated with other portions of the container lid 110.

When the container 120 is heated, the expanded gas or vapor passes through the hole 432 and applies pressure to the top portion 142 and the peripheral portion 106 of the container lid 110 so that the top portion 142 is popped up automatically.

The flange 108 of the container lid 110 removably secures the container lid 110 onto the container 120. The flange 108 may include, among other components, an annular body 412 connected to the peripheral portion 106 and the lower portion 402 and a hook 414 having an inner rib 416. The hook 414 is formed with an inner groove 418 at a surface facing the side wall of the flange 108.

The container 120 has an externally protruding rim 420 at its top rim. When the container lid 110 is pushed down for assembly onto the container 120, the hook 414 deforms outward followed by latching of the hook 414 onto the protruding rim 420. That is, the protruding rim 420 is inserted into the inner groove 418 and the inner rib 416 engages the bottom portion of the protruding rim 420 to lock the container lid 110 onto the container 120. In order to disassemble the container lid 110 from the container 120, the container lid 110 is pulled from the container 120. This causes the hook 414 to deform and release the protruding rim 420 from the inner groove 418.

The connection region 106 may have a thickness t2 that is thinner than the peripheral portion and the lower portion 402 (having a thickness t1). The connection region 106 defines an area where most of the deformation occurs when the peripheral portion 106 is deformed downward to contact the lower portion 402 so that the vent holes 104 are fully blocked when the peripheral portion 106 is deformed downward. Further, the peripheral portion 106 may have a thickness profile that varies from a location where it is connected to the connection region 106 and another location where it is connected to the top portion 142.

Although the container 120 and the container lid 110 are described herein as using the structure of protruding rim 420 and the inner groove 418 to secure the container lid 110 onto the container 120, various other mechanisms such as screws or solid latches may be used to secure the container lid 110 onto the container 120.

Figure 5:
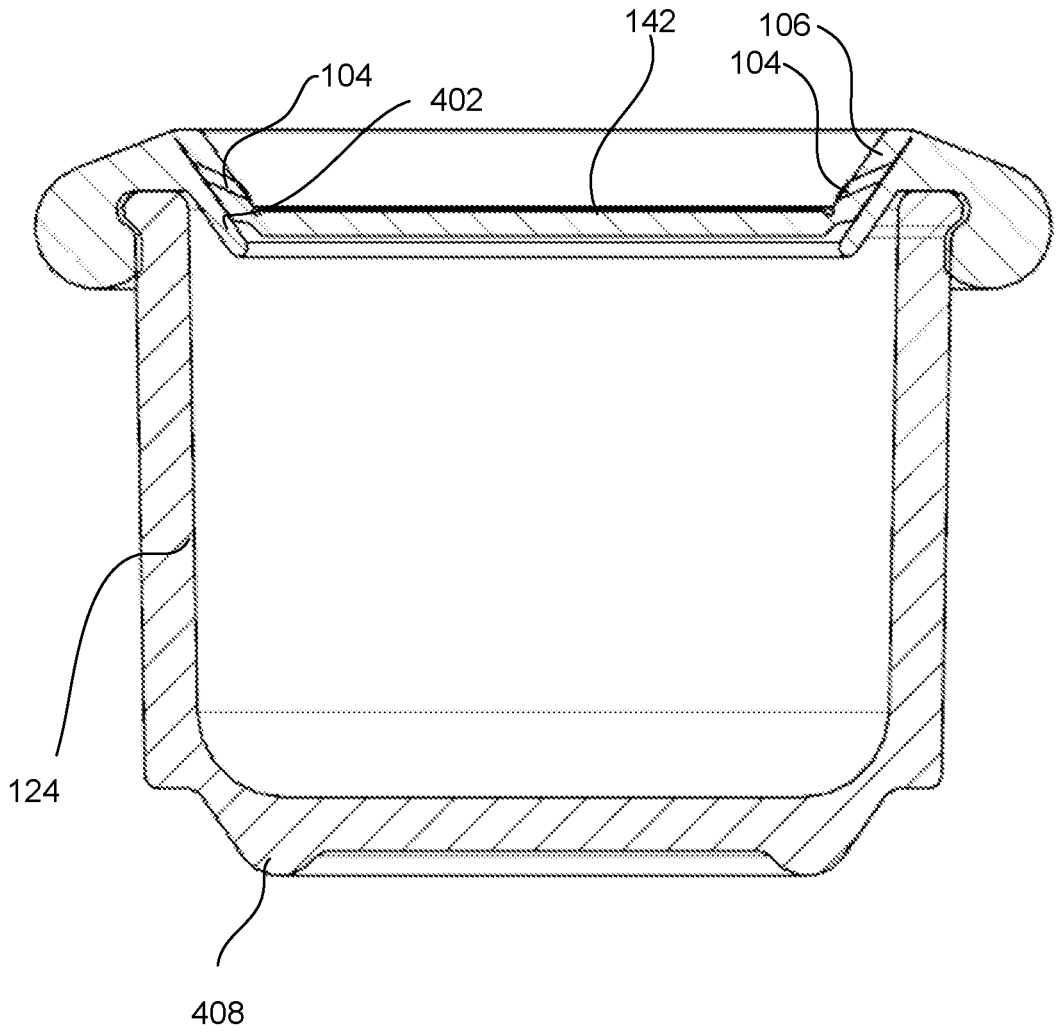
FIG. 5 is a cross-sectional view of the container with the container lid pushed down, according to one embodiment.

FIG. 5 is a cross-sectional view of the container 120 with the container lid 110 pushed down, according to one embodiment. When the top portion 142 of the container lid 110 is pushed down, the peripheral portion 106 contacts the lower portion 402, and thereby, blocks the vent holes 104.

Figure 6:
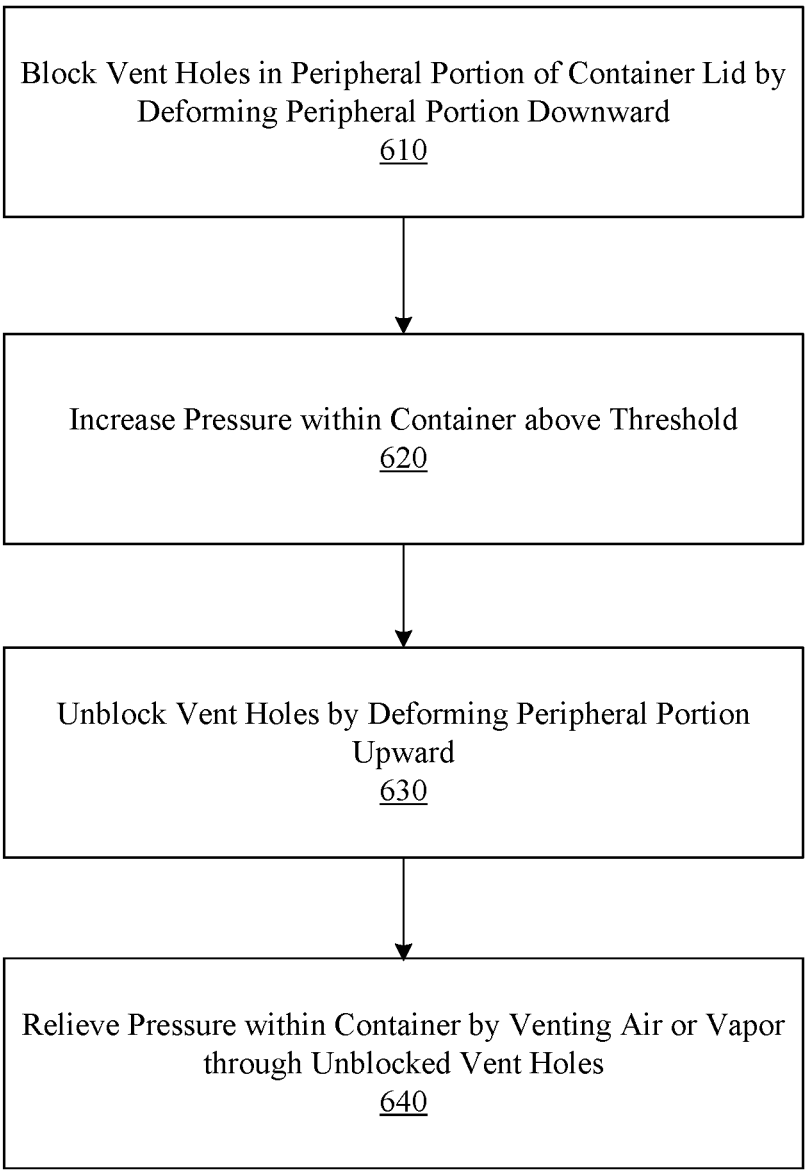
FIG. 6 is a flowchart illustrating a process of operating the container lid, according to one embodiment.

FIG. 6 is a flowchart illustrating a process of operating the container lid 110, according to one embodiment. After placing a food item in the container 120 and assembling the container lid 110 on the container 120, the vent holes 104 formed in the peripheral portion 106 of the container lid 110 are blocked 610 by deforming the peripheral portion 106 downward so that the peripheral portion 106 comes into contact with the lower portion 402. The peripheral portion 106 is deformed, for example, by pushing down a top portion 142 of the container lid 110 by a user. The container 120 may then be stored (e.g., in a refrigerator).

The container 120 may then be retrieved from storage and be heated (e.g., by a microwave oven) for consumption. The heating of the food item increases 620 the pressure within the container 120. When the pressure exceeds a threshold, the peripheral portion 106 deforms and pops the top portion 142. In this way, the peripheral portion 106 is detached from the lower portion 402 of the container lid 110 and unblocks 630 the vent holes 104. Such deformation of the peripheral portion 106 occurs automatically when the pressure within the container 120 exceeds the threshold, and does not involve any manual operation by the user other than heating the container 120.

As the vent holes 104 are unblocked, the pressure within the container 120 is relieved 640 by venting air or vapor through the unblocked vent holes. In this way, building up of excess pressure within the container may be prevented.

Although the present disclosure has been described above with respect to several embodiments, various modifications can be made within the scope of the disclosure. Accordingly, the disclosure described above is intended to be illustrative, but not limiting.

What is claimed is:

1. A container lid, comprising:

a flange configured to attach onto a top end of a container;

a lower portion extending inward and downward from the flange; and an upper portion comprising a top portion and a peripheral portion between the top portion and the flange, the peripheral portion switchable between (i) a first state where the peripheral portion is deformed upward to raise the top portion from the lower portion with the flange attached to the top end of the container, and (ii) a second state where the peripheral portion is deformed downward to lower the top portion onto the lower portion with the flange attached to the top end of the container, the peripheral portion formed with one or more vent holes that are blocked by the lower portion in the second state but opened in the first state, the peripheral portion configured to automatically switch from the second state to the first state to release a gas within the container when pressure of the gas rises above a threshold.

2. The container lid of claim 1, wherein the lower portion and the peripheral portion are separated in the first state and the lower portion contacts the peripheral portion in the second state.

3. The container lid of claim 1, wherein at least the peripheral portion is made of a flexible material.

4. The container lid of claim 3, wherein the flange, the lower portion and the upper portion are integrated as a single body.

5. The container lid of claim 1, wherein the upper portion is bistable at the first state and the second state.

6. The container lid of claim 1, wherein an inner end of the lower portion define a hole open towards the container.

7. The container lid of claim 6, wherein the peripheral portion is connected to the flange via a connection region having a thickness thinner than the peripheral portion and the flange.

8. The container lid of claim 7, wherein the thickness of the peripheral portion at a part connected to the top portion is thicker than at the connection region.

9. The container lid of claim 1, wherein the flange comprises an annular body extending outwards and a hook, the hook having an inner rib and an inner groove that sealingly engage the container.

10. A container assembly comprising:

a container comprising an open top; and a container lid configured to attach to the open top of the container, the container lid comprising:

a flange configured to attach onto a top end of the container;

a lower portion extending inward and downward from the flange; and an upper portion comprising a top portion and a peripheral portion between the top portion and the flange, the peripheral portion switchable between (i) a first state where the peripheral portion is deformed upward to raise the top portion from the lower portion with the flange attached to the top end of the container, and (ii) a second state where the peripheral portion is deformed downward to lower the top portion onto the lower portion with the flange attached to the top end of the container, the peripheral portion formed with one or more vent holes that are blocked by the lower portion in the second state but opened in the first state, the peripheral portion configured to automatically switch from the second state to the first state to release a gas within the container when pressure of the gas rises above a threshold.

11. The container assembly of claim 10, wherein the container comprises an externally protruding rim at the top end.

12. The container assembly of claim 11, wherein the container lid further comprise an annular hook that receives the externally protruding rim when the container lid is assembled onto the container.

13. The container assembly of claim 10, wherein the top portion has a flat top surface facing away from the container.

14. The container assembly of claim 10, wherein the top portion is manually pressed down from the first state to the second state before heating.

15. The container assembly of claim 10, wherein the pressure of the gas is raised in response to heating of content in the container.

16. The container lid of claim 1, further comprising an annular hook that receives an externally protruding rim of the container when the container lid is assembled onto the container.

17. The container lid of claim 1, wherein the top portion has a flat top surface facing away from the container.

18. The container lid of claim 1, wherein the top portion is manually pressed down from the first state to the second state before heating.

19. The container lid of claim 1, wherein the pressure of the gas is raised in response to heating of content in the container.

* * * * *